United States Patent [19]

Raub

[11] 3,980,307

[45] Sept. 14, 1976

[54] STOCK MARKET GAME APPARATUS

[76] Inventor: Donald W. Raub, Box 207, Tylersport, Pa. 18971

[22] Filed: Apr. 14, 1975

[21] Appl. No.: 567,935

[52] U.S. Cl. ..... 273/135 C; 273/135 AC

[51] Int. Cl.[2] ..... A63F 3/00

[58] Field of Search..... 273/134 AF, 134 D, 135 R, 273/135 AA, 135 C, 134 C, 135 AC

[56] References Cited

UNITED STATES PATENTS

| | | | |
|---|---|---|---|
| 971,871 | 10/1910 | Woodruff | 273/134 D |
| 1,113,504 | 10/1914 | Steele | 273/93 R |
| 2,178,330 | 10/1939 | Thomas | 273/134 D |
| 2,526,300 | 10/1950 | Todd | 273/135 C |
| 2,571,403 | 10/1951 | Aird | 273/134 AF |
| 3,033,572 | 5/1962 | Thibault | 273/134 C |
| 3,163,423 | 12/1964 | Jackson | 273/134 AF |
| 3,224,773 | 12/1965 | Roed | 273/93 R |
| 3,427,027 | 2/1969 | Kenyon | 273/134 C |

*Primary Examiner*—Richard C. Pinkham
*Assistant Examiner*—Harry G. Strappello

[57] ABSTRACT

Apparatus is provided for playing a game which similates actual stock market operations as the events which mean a profit or a loss to the players cannot be forecast. It involves throwing dice and matching their numbers with the same numbers on a playing board which identify particular financial instructions. In some instances the instructions are contained in stacks of cards to introduce additional unexpectedness of the transaction.

2 Claims, 14 Drawing Figures

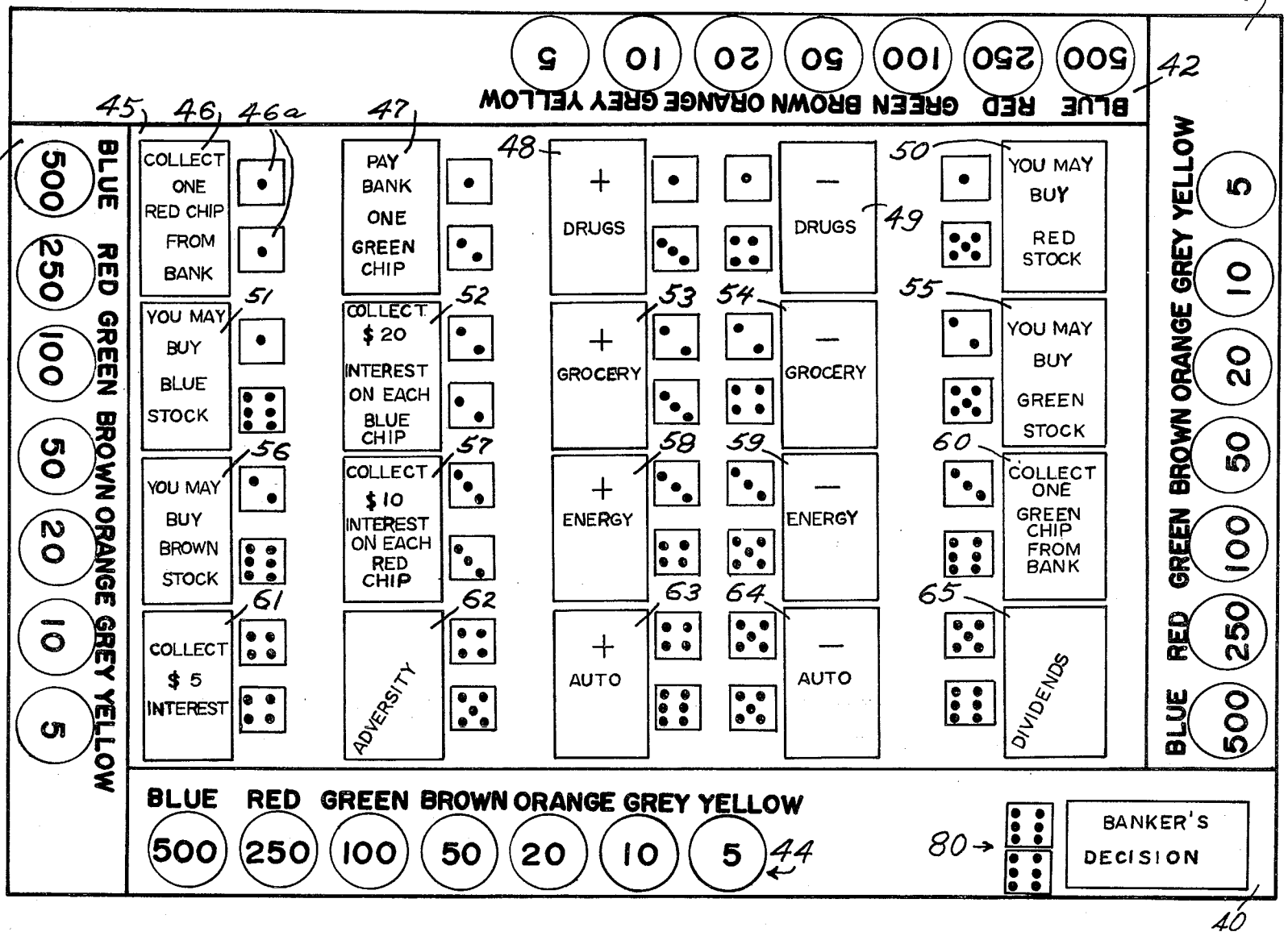
FIGURE 1
FIGURE 2
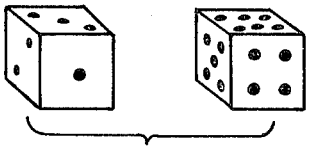
FIGURE 14
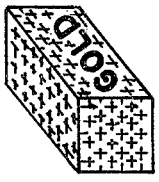

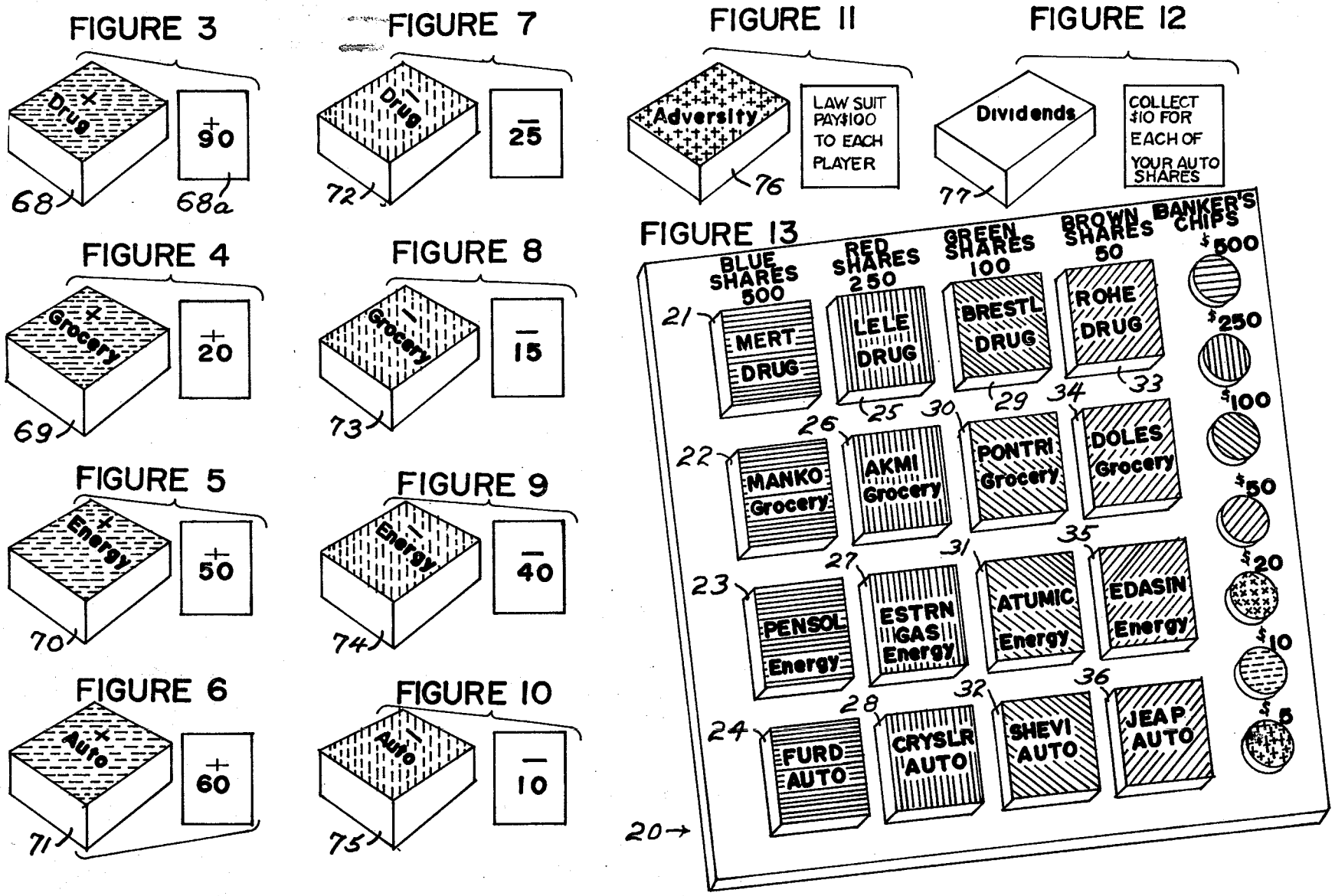
FIGURE 3
Drug
+90
68
68a
FIGURE 4
Grocery
+20
69
FIGURE 5
Energy
+50
70
FIGURE 6
Auto
+60
71
FIGURE 7
Drug
−25
72
FIGURE 8
Grocery
−15
73
FIGURE 9
Energy
−40
74
FIGURE 10
Auto
−10
75
FIGURE 11
Adversity
LAW SUIT PAY $100 TO EACH PLAYER
76
FIGURE 12
Dividends
COLLECT $10 FOR EACH OF YOUR AUTO SHARES
77
FIGURE 13
BLUE SHARES 500
RED SHARES 250
GREEN SHARES 100
BROWN SHARES 50
BANKER'S CHIPS
$500
$250
$100
$50
$20
$10
$5
MERT DRUG
LELE DRUG
BRESTL DRUG
ROHE DRUG
MANKO Grocery
AKMI Grocery
PONTRI Grocery
DOLES Grocery
PENSOL Energy
ESTRN GAS Energy
ATUMIC Energy
EDASIN Energy
FURD AUTO
CRYSLR AUTO
SHEVI AUTO
JEAP AUTO
21
22
23
24
25
26
27
28
29
30
31
32
33
34
35
36
20

STOCK MARKET GAME APPARATUS

This invention relates to game apparatus and more particularly to a playing board and playing items to be used in simulating occurrences which would be experienced by persons engaging in actual stock market transactions. The game to be played is financial in nature and has as its goal the acquisition of a preset high monetary worth.

The so called, ups and downs, of actual stock market operations are well known. When a person buys stock issued by a chosen corporation he does it with the expectation that it will bring him a profit. During his ownership of the stock the corporation which issued it may have a profitable or a loosing operation which will extend to the stock owner. For example, sales may be large or capital assets may be acquired which bring in substantial sums of money which can be passed on to the stock holder. On the other hand, adverse business conditions such as low sales, strikes, law suits and plant disasters may reduce the monetary value of the stock. Almost all of the operations of a corporation are not accurately predictable as they involve complex internal and external influences and these factors introduce an aura of excitement to persons who actively play the stock market.

This same excitement is carried over into the game played with the apparatus of this invention. This apparatus makes it possible to play a game which involves many of the experiences encountered by persons who selectively buy actual corporate stock. During the progress of this game, each player does not know whether his next move will bring him a profit or a loss; nor does he know whether the next move by his coplayers will affect his total monetary worth. These unexpected developments as the game progresses introduce a feeling of tenseness and excitement that holds the players' interest.

Generally considered, each player is given an equal amount of money represented by chips and he uses it to initially buy from the broker or banker his own choice of stock or stocks represented by cards. He may use a portion of or all of his allotted money to buy the stock and he has several corporations to choose from. Then, in turn each player rolls a pair of dice and the numbers which come up on them refer him to information of instructions which direct the performance of a specific financial transaction. This may be some act he performs himself or it may be an act performed by another player which affects him. Or, his instructions may be to pick a top card from a certain stack and he cannot tell what the act is until he has turned the card over.

The player has no control over the different financial events which occur and he must hope for the best just like he would if he bought stock on the actual market. All of the designated events of the game similate actual stock market experiences as they result in erratic gains and losses to each player. The eventual outcome is that one player first reaches a preset total financial worth. This may, for instance, be that his total worth is enough to purchase a similated gold brick.

The game apparatus is illustrated in the accompanying drawings in which:

FIG. 1 is the playing board which has thereon defined areas for holding certain playing items and for giving specific playing instructions and information, FIG. 2 shows the conventional dice used in playing the game, FIG. 3 shows a stack of "DRUG +" cards and the under side of one of them, FIG. 4 shows a stack of "GROCERY +" cards and the under side of one of them, FIG. 5 shows a stack of "ENERGY +" cards and the under side of one of them, FIG. 6 shows a stack of "AUTO +" cards and the under side of one of them, FIG. 7 shows a stack of "DRUG −" cards and the under side of one of them, FIG. 8 shows a stack of "GROCERY −" cards and the under side of one of them, FIG. 9 shows a stack of "ENERGY −" cards and the under side of one of them, FIG. 10 shows a stack of "AUTO −" cards and the under side of one of them, FIG. 11 shows a stack of "ADVERSITY" cards and the under side of one of them, FIG. 12 shows a stack of "DIVIDENDS" cards and the under side of one of them, FIG. 13 shows the banker's or broker's board with stacks of corporation stock certificates (cards) thereon and also stacks of money (chips) as they appear at the start of the game and FIG. 14 is the block which represents a gold brick which can be purchased by the player who first attains that wealth.

The game and its playing apparatus is probably best explained by first describing the playing items on the board 20 of FIG. 13 as this is what the banker has before him at the start of the game. At the extreme right of the board is a vertical row of money chips, each stack having a specified value and its own identifying color. Each chip of the topmost stack is colored blue and is worth $500. Going down the line, the $250 chips are red, the $100 chips are green, the $50 chips are brown, the $20 chips are orange, the $10 chips are gray and the $5 chips are yellow.

At the extreme left of the banker's board 20 is a vertical line-up of four stacks of cards which represent expensive shares of stocks valued at $500 each and which are all colored blue. Each of the four stacks represents a different corporation, namely, 21 is MERT DRUG, 22 is MANKO GROCERY, 23 is PENSOL ENERGY and 24 is FURD AUTO. Next to the right is a vertical line-up of four stacks of cards which represent high priced shares of stocks valued at $250 each and which are all colored red. Each of these four stacks represents a different corporation, namely, 25 is LELE DRUG, 26 is AKMI GROCERY, 27 is ESTRN GAS and 28 is CRYSLR AUTO.

Next to the right on board 20 is a vertical line-up of four stacks of cards which represent medium priced shares of stocks valued at $100 each and which are colored green. Each of these four stocks represents a different corporation, namely, 29 is BRESTL DRUG, 30 is PONTRI GROCERY, 31 is ATUMIC ENERGY and 31 is SHEVI AUTO. The right-most vertical line-up of four stacks of cards represent low priced shares of stocks valued at $50 each and which are colored brown. Each of these four stocks represents a different corporation, namely, 33 is ROHE DRUGS, 34 is DOLES GROCERY, 35 is EDASIN ENERGY and 36 is JEAP AUTO.

It should be noted that the top horizontal row of stock shares are all of drug corporations. The next lower horizontal row of stock shares are all grocery corporations. The third down horizontal row of stock shares are all energy corporations. The bottom horizontal row of stock shares are all auto corporations. The stocks in a vertical row are all priced the same and the stocks in a horizontal row are all of the same type of business enterprise.

FIG. 1 should now be observed as it shows the playing board 39 which preferably is made of strong cardboard material. On each of its four sides are the marked out strips 40, 41, 42 and 43, one being assigned to each player. Within the strip 40 and the encircled spaces which are marked to indicate where that player is to stack his chips. This is shown as the row 44 and this same row is duplicated in each of the other strip areas 41, 42, and 43. The colors and values correspond, or course, to the chips in the bankers row of chips shown in FIG. 13.

The instructional information for each play is designated within or carried within the central area 45 of the board within the peripheral strips 40, 41, 42 and 43. At the upper left-hand corner of this area 45 is a marked off oblong space 46 with the words "Collect One Red Chip from Bank" printed in it. Along side of this area 46 are two smaller, square areas **46*a* each having within it a single dot. These correspond to what might come up on the dice after a throw and for convenience this will be referred to as a 1+1 throw. If a player has a 1+1 throw of the dice he refers to the play board 39** and the words in the space along side of that throw tell him what to do.

The central area 45 of the play board contains twenty oblong marked spaces corresponding to the space 46. There are four horizontal rows of them and there are five oblong marked spaces in each row. They are designated 46 to 65 inclusive and along side of each of them is a pair of square areas which have within them the dots corresponding to the possible throws of the dice. For instance, if the player has a 1+2 throw he refers to the instructions in oblong space 47.

The instructional information contained in spaces 46, 47 50, 51, 52, 55, 56, 57, 60, 61, and 65 are self explanatory and need not be repeated nor described further here. The suggested purchase of stock means, of course, that it can be procured from the banker if he has it remaining to sell. In like manner, the informations for the 2+2 throw and 4+4 throw mean that the money is to be collected from the banker. If a player has a 3+3 throw but does not have any red chips he does not collect the interest from the bank.

On each of the oblong spaces 48, 49, 53, 54, 58, 59, 62, 63, 64 and 65 is one of the stacks of cards illustrated in FIGS. 3 to 12 inclusive. On space 48 is the stack of cards 68 of FIG. 3 and this placement is simplified because the space 48 is marked "+DRUGS" and the backs of all of the cards 68 have this same designation. The face sides **68*a*** all have a + mark on them but they have different dollar numbers on them to indicate their respective values. They may differ by $5 amounts from $5 up to $100 so that until a player turns the card over he does not know how much money he is to receive from the banker. The cards may not go so low in value or so high in value and they may differ by say, $10 more or less.

The + cards in piles 69, 70, and 71 are like those in stack 68 but are for the enterprises named on their backs. To identify these + cards better and make them easier to resort and replace in the proper stack they are colored gray. In each stack, the number values are preferably in random order. The location of each stack 68, 69, 70 and 71 on the marked spaces 48, 53, 58 and 63 is apparent.

The cards in stacks 72, 73, 74 and 75 go, respectively, on the spaces 49, 54, 59 and 64 and they are similar to the + cards just described except that they are for negative or − values. To identify them they are colored purple but they have to be separated in the four stacks according to the enterprises. If a player has a 2+4 dice throw, for instance, he turns over the top card of stack 73 on space 54 and pays the broker in chips the specified amount.

On the space 62 marked on the bank card is the stack of yellow cards 76 and they all bear the word "Adversity" on their backs. If a player has a 4+5 dice throw he picks up the top card and finds that it says, for instance, "Law Suit — Pay $100 to Each Player." He must do this and if he does not have enough money chips he must sell stock certificate cards back to the banker for half of their face value. Other cards in this Adversity pile 76 may specify such losses as:

Akmi Strike — pay $10 to each Akmi stockholder
Sales Loss — pay $15 to each Atumic stockholder
Inflation — pay $20 to each Pensol stockholder
Acquisition — 1 for 2 on all Brown stock you own
Unemployment Compensation — pay $50 to each player
Energy Storm — pay $10 to each player
The Great Depression — You Are Busted The other cards in the Adversity stack 76 may name the same penalty in the above list but the other enterprises or stock colors may be named. Still other losses can be named.

On the space 65 on the play board is the stack of white cards 77 and they all bear the word "Dividends" on their backs. If a player has a 5+6 dice throw he picks up the top card and finds that it says, for instance, "Collect $10 for each of your auto shares." The banker must pay him this amount. Other cards in this Dividends pile 77 may say, for instance:

Collect $20 for each Mert Drug stock you own All Energy stock owners pay you $50 for expansion New Auto — Furd Auto doubles in price, collect $500 for each Split 2 for 1 on all green shares you own Other gains may be named on the other "Dividends" cards in this stack 77. For instance, they may name the same monetary benefits in the above list but the other enterprises or stock colors may be named.

There are 21 possible throws of the dice and the highest is a 6+6 which is shown in the small squares at 80 on the playing board. This identifies the marked oblong space with the words "Banker's Decision" in it. At the start of the game the banker is privileged to name the gain or loss which is to be experienced by a person who throws a 6+6 with the dice. This may be that the player gets $50 from the bank or pays $50 to the bank, or that he collects $10 from each player or pays each player that amount. Other transactions such as the purchase of certain stock may be initially spelled out by the banker.

From two to four persons may play the game. The banker gives each player $2000 in chips, using his judgment as to how many of what chips will be given. The dice may be rolled to find who gets the highest number and begins the playing. First, he buys up to $1000 worth of his own selection of stock and then each player on his left may do the same in turn, each buying up to $1000 worth of what he wants. After this initial investment stock may be purchased only when his dice roll tells him he may buy. He buys only if he wishes to.

After all players have made their initial investment they continue to roll the dice follow the instructions or information identified by the dice numbers which come up. If he is required to take a card from the top of one of the stacks he performs it and puts it at the bottom of that stack. The players should have no trouble following the instructions but the following clarification may be in order. The "Acquisition 1 for 2 " means that if a player has two shares he must give the banker one or pay the banker its value in chips. If the player has only one share he pays half its value to the banker but if he has no shares he pays nothing.

The "Split 2 for 1 " card may be clarified by explaining that if the player has one share the banker gives him another share; if the player has three shares the banker gives him three shares, free. If there are not enough of the same kind in the bank the player may choose another stock of equal value but if there if none of equal value the player must be paid its value in chips.

The game is not one which is played entirely by chance as the player must exercise tactical judgment. For instance he must not overpurchase stock as if he is required to pay out a sum of money and he does not have it, he must sell stock at half price and take a loss. Or, if he does not have stock of a certain enterprise or corporation or color, he cannot collect dividends or other benefits if this is called for. Likewise, if he does not have the stock if it reaches an adverse condition he does not sustain that loss. These possibilities sustain the excitement of playing the game and to a considerable degree make it similate the ups and downs, the profits and losses, of engaging in actual stock market transactions.

It is of course possible to vary the values and colors of the cards, of the chips and the stock certificates without departing from or altering the basic nature of the apparatus or of the game which is played.

As is mentioned above the winner is the first person whose total assets add up to an amount set by the banker at the start of the claim. For instance, this may be a goal of $5000 or $10,000 and its amount will determine the time to play a game. To add interest to the game the gold brick of FIG. 14 may be purchased by the winner, at its preset price.

I claim:

1. A game apparatus comprising:

1. dice, each of which has a distinct identifying symbol on each face different from that on any other of its faces,
2. a playing board having a plurality of individualized spaces marked thereon, the individualized spaces each having a distinct identifying symbol identical to only one pair of the dice symbols,
3. some spaces having additional indicia thereon,
4. a stack of cards on each of other ones of said spaces,
   a. all the cards in each stack differing from the cards in the other stacks,
   b. each card in each stack differing from all other cards in the same stack,
5. stock certificate cards and
6. money means to transact financial operations.

2. The game apparatus of claim 1 in which there are two dice and they are identical as to their identifying symbols.

* * * * *